US008661870B1

(12) United States Patent
Ade

(10) Patent No.: US 8,661,870 B1
(45) Date of Patent: Mar. 4, 2014

(54) TOOLING SYSTEM

(71) Applicant: James Corbett Ade, Moore, SC (US)

(72) Inventor: James Corbett Ade, Moore, SC (US)

(73) Assignee: Spartanburg Steel Products, Inc., Spartanburg, SC (US)

( * ) Notice: Subject to any disclaimer, the term of this patent is extended or adjusted under 35 U.S.C. 154(b) by 0 days.

(21) Appl. No.: 13/736,367

(22) Filed: Jan. 8, 2013

(51) Int. Cl.
*B21J 13/02* (2006.01)
*B21D 37/04* (2006.01)

(52) U.S. Cl.
USPC ..... 72/476; 72/413; 72/446; 72/455; 72/481.3; 29/428; 100/295; 100/918

(58) Field of Classification Search
USPC ..... 72/348, 413, 446, 448, 455, 456, 462, 72/476, 477, 478, 481.3, 481.8; 100/35, 100/295, 918; 83/637; 29/428
See application file for complete search history.

(56) References Cited

U.S. PATENT DOCUMENTS 2,108,253 A 2/1938 Dense
3,702,560 A * 11/1972 Weidel ..... 72/482.1
3,942,354 A 3/1976 Randolph, Sr.
4,254,999 A * 3/1981 Davidson ..... 384/42
5,715,721 A * 2/1998 Anders et al. ..... 72/311
6,691,547 B2 * 2/2004 Cutshall et al. ..... 72/404
6,874,346 B1 * 4/2005 Faymonville ..... 72/389.4
7,000,446 B2 * 2/2006 Nieschulz et al. ..... 72/350
7,770,430 B2 * 8/2010 Miceli et al. ..... 72/478
7,942,030 B2 * 5/2011 Miceli et al. ..... 72/478
7,980,112 B2 7/2011 Boersma

* cited by examiner

*Primary Examiner* — Jimmy T Nguyen
(74) *Attorney, Agent, or Firm* — Brouse McDowell; Heather M. Barnes

(57) ABSTRACT

Provided is a tooling system for use in an associated press comprising a lower tool shoe, an upper tool shoe, a first set of tooling plates, and a second set of tooling plates. The lower tool shoe comprises an upwardly facing surface, part of a shoe locator set defining an axis of elongation, a first locator element defining an axis of elongation, and an offset second locator element defining an axis of elongation. The upper tool shoe comprises a downwardly facing surface, part of a shoe locator set defining an axis of elongation, a first locator element defining an axis of elongation, and an offset second locator element defining an axis of elongation. The first set of tooling plates comprises a first lower tooling plate and a first upper tooling plate. The second set of tooling plates comprises a second lower tooling plate and a second upper tooling plate.

5 Claims, 7 Drawing Sheets

TOOLING SYSTEM

TECHNICAL FIELD

The present subject matter relates generally to a tooling system for use in an associated press. More specifically, the present subject matter relates to interchangeable tooling plates for use in an associated press.

BACKGROUND

Presses are used for a variety of forming and cutting operations. A given press may be operationally engaged with any of a wide variety of tooling components to perform a desired operation. Changing the operation of a press may involve changing out the tooling components operationally engaged therewith.

It is common for a set of tooling elements to be installed in a lower die shoe and for counterpart tooling elements to be installed in an upper die shoe adapted for slidable engagement with the lower die shoe. Changing out of tooling components may require that the entire die shoe in which they are installed be changed out of the press or otherwise removed from operational engagement with the associated press. Removing a die shoe from operational engagement with an associated press can be time consuming, labor intensive, and costly.

It remains desirable to develop a tooling system which permits a first set of tooling components engaged with a first die shoe to be exchanged a second set of tooling components engaged with a second die shoe.

SUMMARY

Provided is a tooling system for use in an associated press which may comprise a lower tool shoe, an upper tool shoe, a first set of tooling plates, and a second set of tooling plates. The lower tool shoe may comprise an upwardly facing surface, part of a shoe locator set defining an axis of elongation, a first locator element defining an axis of elongation, and an offset second locator element defining an axis of elongation. The upper tool shoe may comprise a downwardly facing surface, part of a shoe locator set defining an axis of elongation, a first locator element defining an axis of elongation, and an offset second locator element defining an axis of elongation. The first set of tooling plates may comprise a first lower tooling plate and a first upper tooling plate. The second set of tooling plates may comprise a second lower tooling plate and a second upper tooling plate.

DETAILED DESCRIPTION

Figure 1:
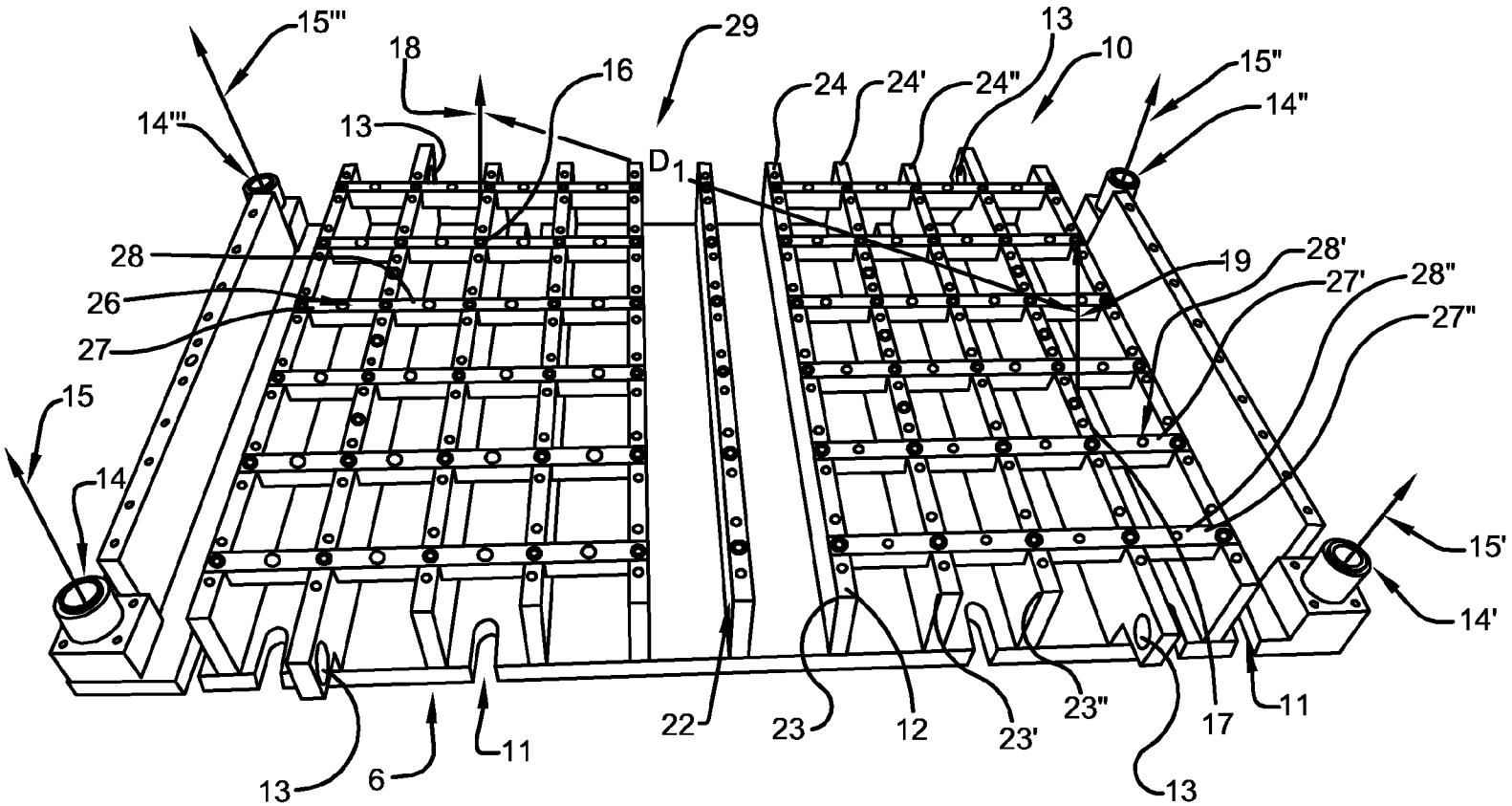
FIG. 1 shows a perspective view of a lower tool shoe of a tooling system adapted for use in an associated press.

Reference will be made to the drawings, FIGS. 1-7*d* wherein the showings are only for purposes of illustrating certain implementations of a tooling system.

Referring now to FIGS. 1-7*d*, shown are implementations of components of an interchangeable tooling system. An interchangeable tooling system may comprise a lower tool shoe 10 adapted for engagement with an associated press 4, an upper tool shoe 30 adapted for engagement with the associated press 4, a first tooling plate set 50, 60, and a second tooling plate set 70, 80.

The lower tool shoe 10 may comprise, an upwardly facing contact surface 12, a first part 14 of a first elongated shoe locator set 74, a first lower tooling plate locator element 16, and a second lower tooling plate locator element 17. FIG. 1 shows a first non-limiting implementation of the lower tool shoe 10. In the first implementation shown in FIG. 1 of lower tool shoe 10 the upwardly facing contact surface 12 is defined by a first elongated beam set 22 which may comprise a beam 23 having a top surface 24 which defines the upward facing contact surface 12. As shown in FIG. 1, the first elongated beam set 22 may comprise a plurality of beams 23, 23', 23". In other implementations, the first elongated beam set 22 may comprise one beam 23, two beams 23, 23', or some other number of beams 23, 23', 23". In the implementation shown in FIG. 1, each beam defines a top surface 24, 24', 24" and the top surfaces 24, 24', 24" all substantially coincide with one another and with the upward facing contact surface 12. In the first implementation shown in FIG. 1, the upward facing contact surface 12 is substantially parallel with and faces in the opposite direction from a press engagement surface 6 of the lower tool shoe 10 so that, when installed on the bed 5 of the associated press 4, the upward facing contact surface 12 will have substantially the same facing as the bed 5 of the associated press. In the implementation shown in FIG. 1, the upwardly facing contact surface 12 is further defined by a first elongated bar set 26 which may comprise a bar 27 comprising a top surface 28 which may be substantially coincident with the upward facing contact surface 12. As shown in FIG. 1, the first elongated bar set 26 may comprise a plurality of bars, such as 27, 27', 27". In other implementations, the first elongated bar set 26 may comprise one bar 27, two bars 27, 27', or some other number of bars 27, 27', 27". In the implementation shown in FIG. 1, each bar may define a top surface 28, 28', 28" and the top surfaces 28, 28', 28" all substantially coincide with one another and with the upward facing contact surface 12. In the implementation shown in FIG. 1, the bars 27, 27', 27" are all parallel to one another and are perpendicular to the beams 23, 23', 23". In other implementations, the bars 27, 27', 27" may not be parallel to one another and/or may intersect the beams 23, 23', 23" at other angles, such as without limitation, 45 degrees, 30 degrees, or at some other angle chosen with sound engineering judgment.

As shown in FIG. 1, the lower tool shoe 10 may optionally comprise features or components to facilitate installation or removal of the lower tool shoe 10 from the associated press 4. Features or components to facilitate installation or removal of the lower tool shoe 10 from the associated press 4 may comprise, but are not limited to, a feature adapted to be engaged with a crane, hoist, handle, or other lifting or carrying device or system such as a lift point 13, or a hoist ring. Features or components to facilitate installation or removal of the lower tool shoe 10 from the associated press 4 may comprise, but are not limited to, a feature adapted to be engaged or mated with a fastener engaged with the bed 5 of the associated press 4 such as a bolting slot 11, through hole, or clamping point.

Figure 2:
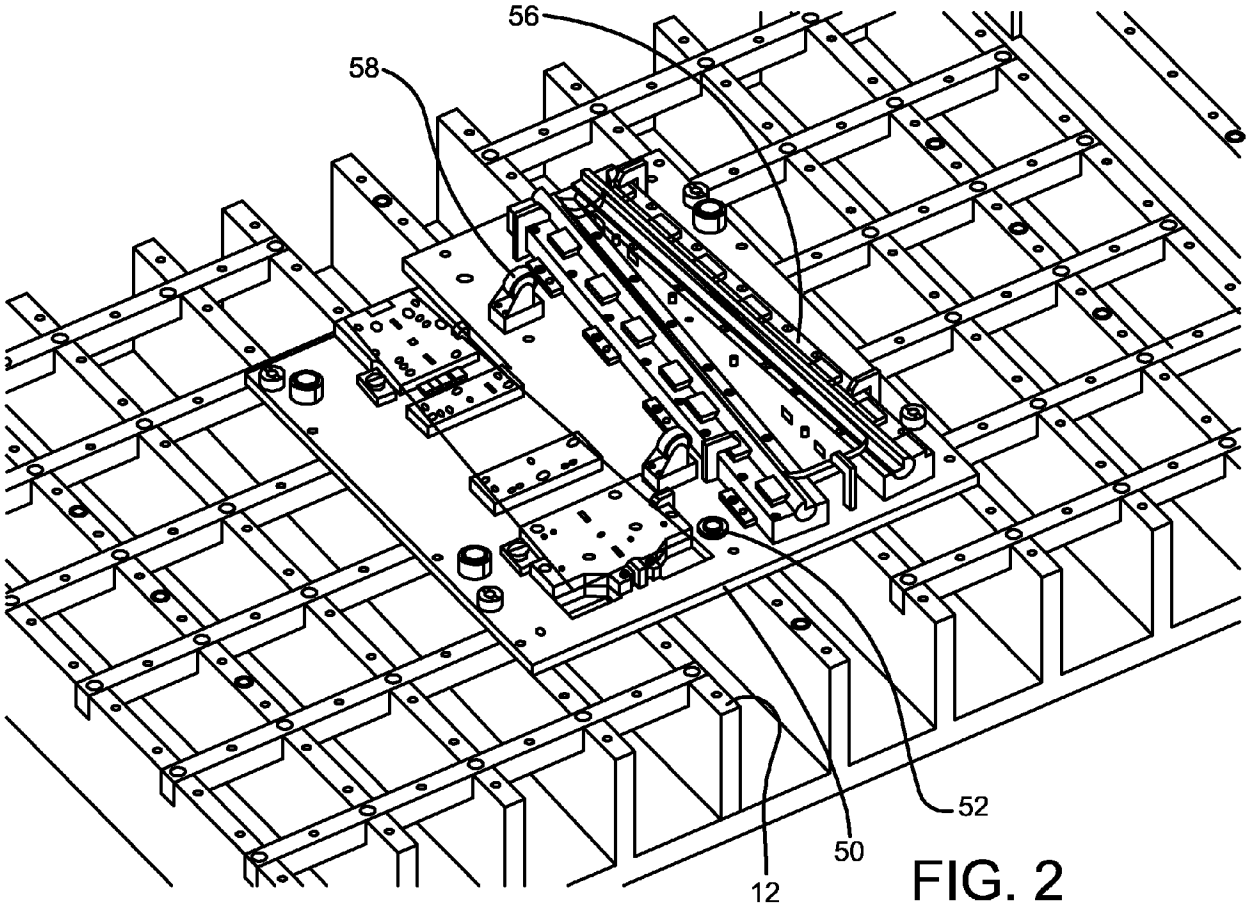
FIG. 2 shows a perspective view of a lower tool shoe with a first tooling plate and first set of tool components engaged therewith.
Figure 3:
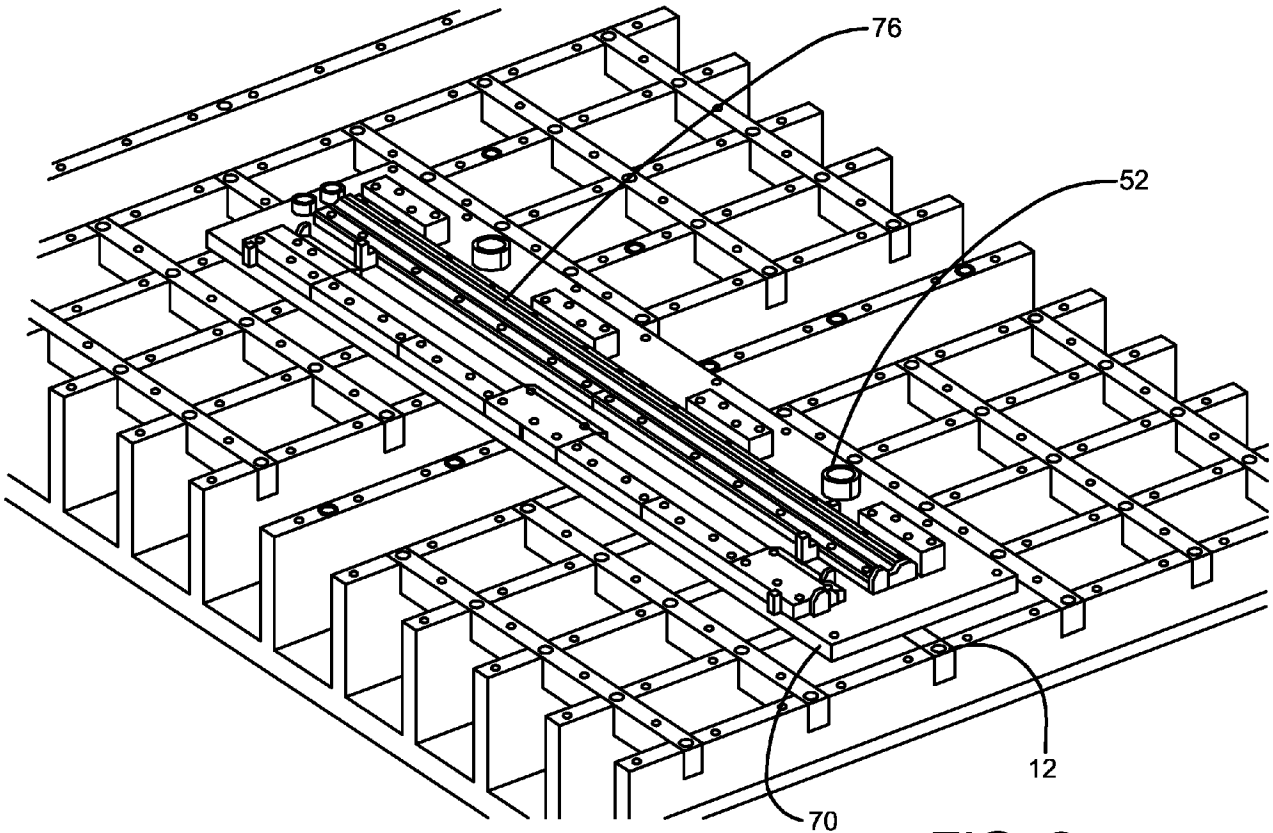
FIG. 3 shows a perspective view of a lower tool shoe with a first tooling plate and first set of tool components engaged therewith.

As shown in FIGS. 1-3, the lower tool shoe 10 may comprise the first lower tooling plate locator element 16, and the second lower tooling plate locator element 17. In some implementations, such as those shown in FIGS. 1-3, the first lower tooling plate locator element 16 may be fixed to the upwardly facing contact surface 12. In some implementations, such as those shown in FIGS. 1-3, the second lower tooling plate locator element 17 may be fixed to the upwardly facing contact surface 12. A lower tooling plate locator element 16, 17 is a component, which is adapted to provide positive engagement in two dimensions to a counterpart element such as, without limitation, a lower tooling plate 50, 70, and thereby to be usable to define a location in two dimensions. First lower tooling plate locator element 16 defines a first lower tooling plate locator element axis of elongation 18. Second lower tooling plate locator element 17 defines a second lower tooling plate locator element axis of elongation 19. In certain implementations, such as, and without limitation, that shown in FIG. 1, the second lower tooling plate locator element 17 and the second lower tooling plate locator element axis of elongation 19 defined thereby, are parallel with the first lower tooling plate locator element axis of elongation 18. In certain implementations, such as, and without limitation, that shown in FIG. 1, the second lower tooling plate locator element 17 and the second lower tooling plate locator element axis of elongation 19 defined thereby, are parallel with and offset by some offset distance, $D_1$, from the first lower tooling plate locator element axis of elongation 18.

The lower tooling plate locator element 16, 17 may comprise a pin, a shaft, stud, a threaded projection, a cone locator, other male component, a blind hole, a through hole, a threaded hole, other female component, or other element chosen with sound engineering judgment. In some implementations, the lower tooling plate locator element 16, 17 may have a substantially circular cross-section such that a counterpart element engaged therewith may be fixed in location in at least two dimensions, but is still free to rotate thereabout such that its orientation is not fixed. In some implementations, the lower tooling plate locator element 16, 17 may have a substantially circular cross-section such that a counterpart element engaged with both lower tooling plate locator elements 16, 17 may be fixed in location in at least two dimension and is also fixed in orientation.

In the implementation shown in FIGS. 1-3, the lower tooling plate locator elements 16, 17 are fixed to the upwardly facing contact surface 12, the surface 12 defines a locator surface in a first dimension, and each lower tooling plate locator element 16, 17 provides a location in two other dimensions each perpendicular to the first dimension and to one another, such that the lower tool locator elements 16, 17, in combination with the upwardly facing contact surface 12, provides a positive location in three dimensions and fixes the orientation of a counterpart element, such as, without limitation, the lower tooling plate 50, 70, engaged with the first lower tooling plate locator element 16, the second lower tooling plate locator element 17, and the upwardly facing contact surface 12.

In certain implementations such as, without limitation, those shown in FIGS. 1-3, the lower tool shoe 10 may comprise a lower tooling plate locator element array 29 comprising a plurality of lower tooling plate locator elements 16, 17. The lower tooling plate locator element array 29 may comprise ten lower tooling plate locator elements 16, 17, one hundred lower tooling plate locator elements 16, 17, or more lower tooling plate locator elements 16, 17. The lower tooling plate locator element array 29 may be a rectangular array, a hexagon array, or another sort of array chosen with sound engineering judgment.

Referring now to FIGS. 2-3, shown are a first lower tooling plate 50, and a second lower tooling plate 70. The first lower tooling plate 50 may be a component of a first tooling plate set 50, 60. As will be described herebelow, another component of the first tooling plate set 50, 60 and counterpart to first lower tooling plate 50 may be the first upper tooling plate 60. The second lower tooling plate 70 is a component of a second tooling plate set 70, 80. As will be described herebelow, another component of the second tooling plate set 70, 80 and counterpart to second lower tooling plate 70 may be the second upper tooling plate 80. The tooling plates 50, 60, 70, 80 may be adapted to engage tooling elements such as a punch, a die, another forming component 56, or another component 58 commonly used in the associated press 4.

In FIG. 2, the first lower tooling plate 50 may be adapted to be positively located on the upwardly facing contact surface 12 of the lower tool shoe 10. Engagement of the first lower tooling plate 50 with the upwardly facing contact surface 12 may be by simultaneous engagement with the upwardly facing contact surface 12, engagement with the first lower tooling plate locator element 16, and engagement with the second lower tooling plate locator element 17. Engagement of the first lower tooling plate 50 with the upwardly facing contact surface 12 may be affected by placing the first lower tooling plate 50 on the upwardly facing contact surface 12. Engagement of first lower tooling plate 50 with the first lower tooling plate locator element 16 may be affected by engaging a cone locator, pin, or other mechanical locator 52 with the first lower tooling plate locator element 16 and with the first lower tooling plate 50. Engagement of the first lower tooling plate 50 with the second lower tooling plate locator element 17 may be affected by engaging the cone locator, pin, or other mechanical locator 52, with the first lower tooling plate locator element 16 and with the first lower tooling plate 50. The first lower tooling plate 50 may be further engaged with the lower tool shoe 10 by mechanical fasteners such as bolts or nuts.

In FIG. 3, the second lower tooling plate 70 is adapted to be positively located on the upwardly facing contact surface 12 of the lower tool shoe 10. Engagement of the second lower tooling plate 70 with the upwardly facing contact surface 12 may be by simultaneous engagement with the upwardly facing contact surface 12, engagement with the first lower tooling plate locator element 16, and engagement with the second lower tooling plate locator element 17. Engagement of the second lower tooling plate 70 with the upwardly facing contact surface 12 may be affected by placing the second lower tooling plate 70 on the upwardly facing contact surface 12. Engagement of the second lower tooling plate 70 with the first lower tooling plate locator element 16 may be affected by engaging a cone locator, pin, or other mechanical locator 52, with the first lower tooling plate locator element 16 and with the second lower tooling plate 70. Engagement of the second lower tooling plate 70 with the second lower tooling plate locator element 17 may be affected by engaging a cone locator, pin, or other mechanical locator 52, with the first lower tooling plate locator element 16 and with the second lower tooling plate 70. The second lower tooling plate 70 may be further engaged with the lower tool shoe 10 by mechanical fasteners such as bolts or nuts.

Figure 4:
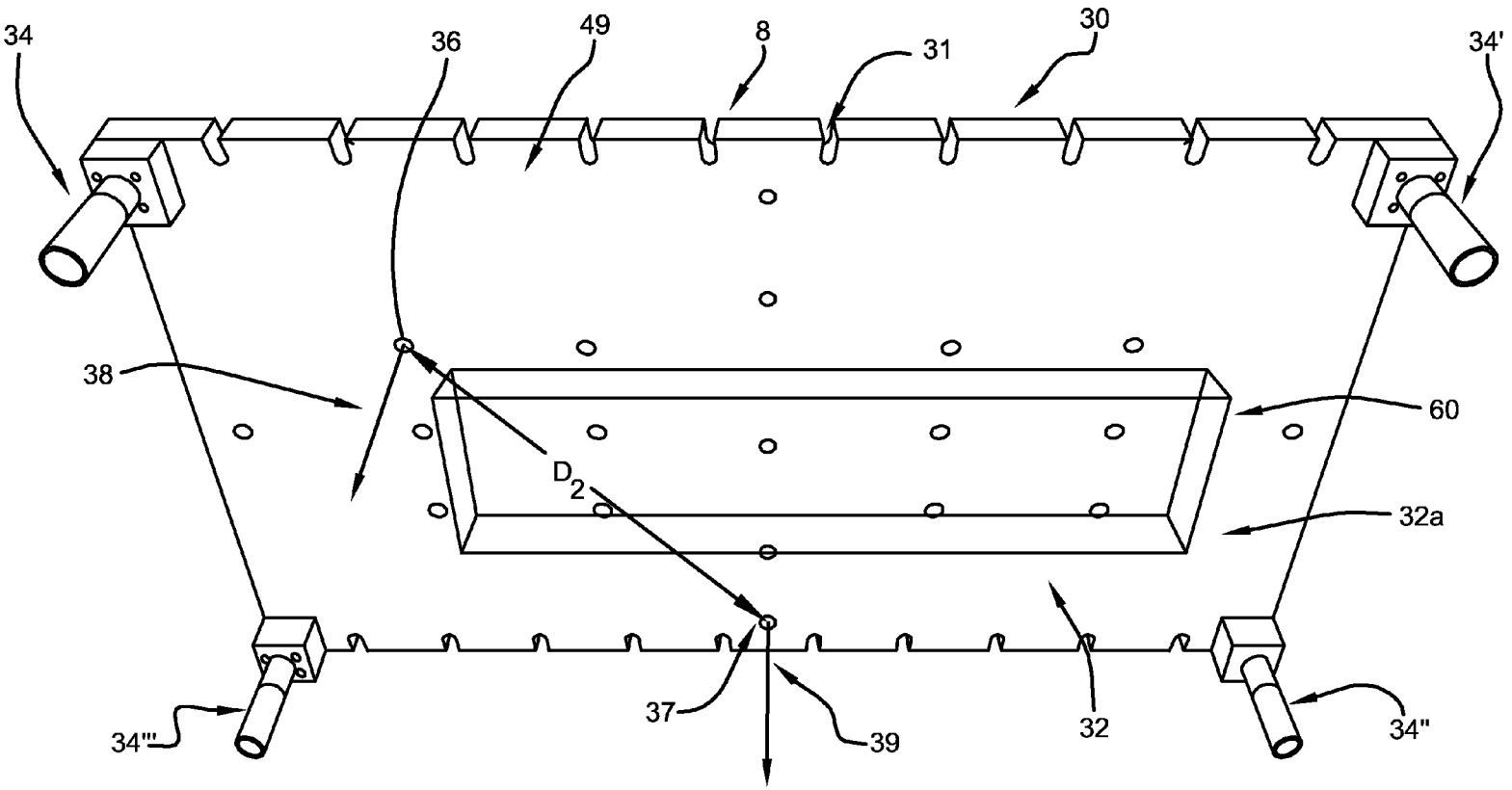
FIG. 4 shows a perspective view of an upper tool shoe of a tooling system adapted for use in an associated press.

The upper tool shoe 30 may comprise a downwardly facing contact surface 32, a second part 34 of a first elongated shoe locator set, a first upper tooling plate locator element 36, and a second upper tooling plate locator element 37. FIG. 4 shows a first non-limiting implementation of the upper tool shoe 30.

In the first implementation shown in FIG. 4 of the upper tool shoe 30, the downwardly facing contact surface 32 may be defined by a plate 32*a*. In other implementations, the downwardly facing contact surface 32 may be defined by an elongated beam set, with or without the bars, analogous to that shown in FIG. 1 and described above. In the implementation shown in FIG. 4, the downwardly facing contact surface 32 may be substantially parallel with and faces in the opposite direction from the press engagement surface 8 of the upper tool shoe 30 so that, when installed on the ram 7 of an associated press 4, contact surface 32 will have substantially the same facing as the ram 7 of the associated press 4. As shown in FIG. 4, the upper tool shoe 30 may optionally comprise features or components to facilitate installation or removal of the upper tool shoe 30 from the associated press.

Figure 5:
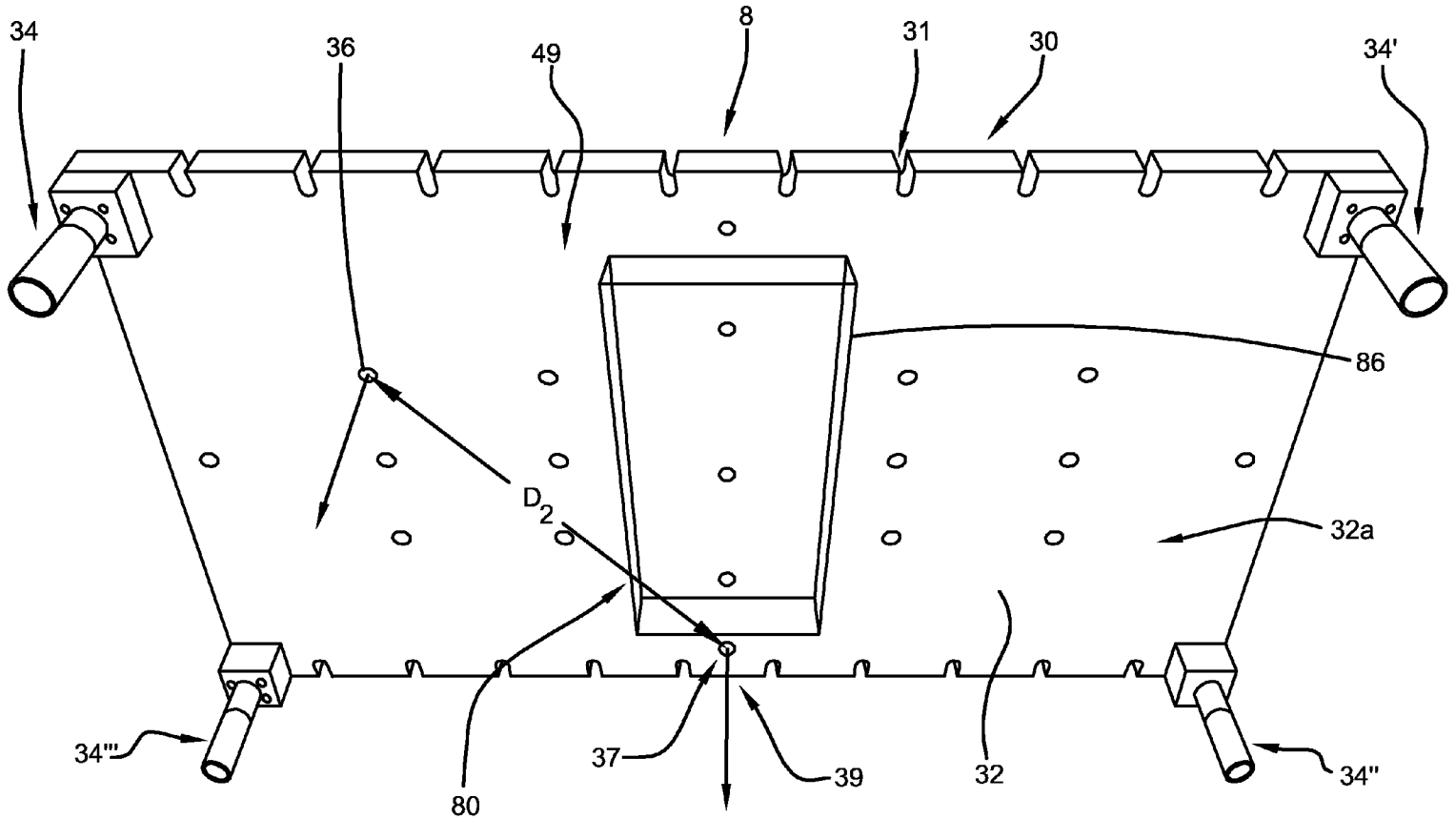
FIG. 5 shows a perspective view of an upper tool shoe of a tooling system adapted for use in an associated press.
Figure 6:
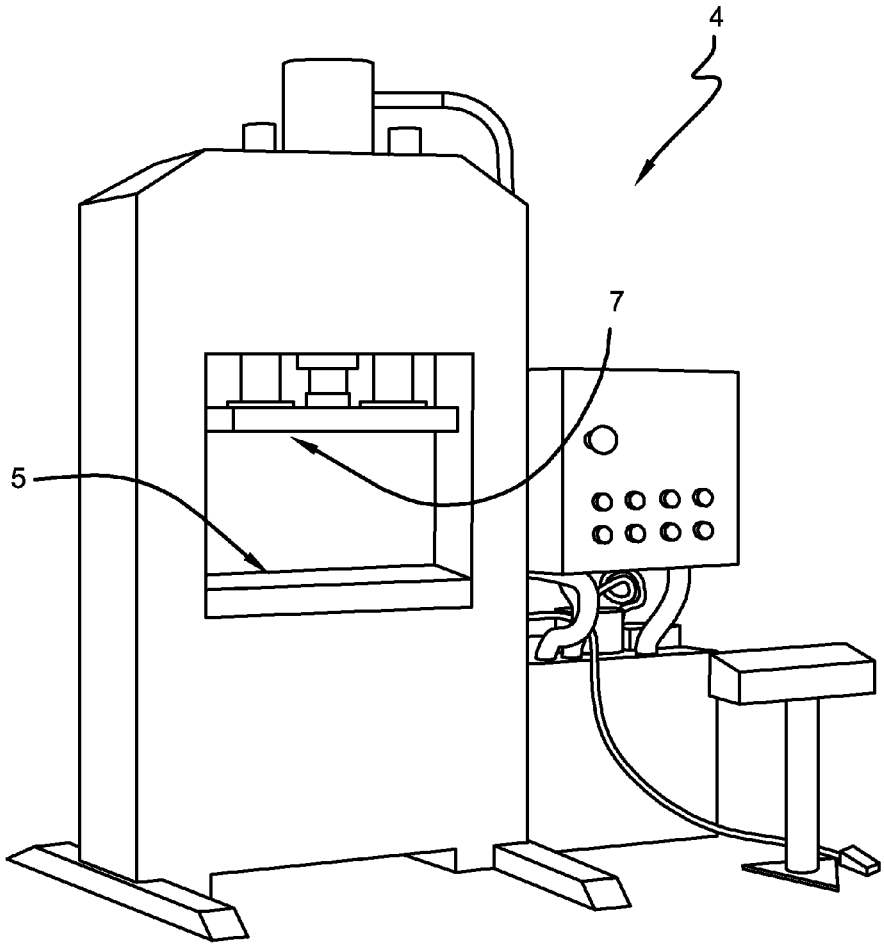
FIG. 6 shows an associated press.
Figure 7A:
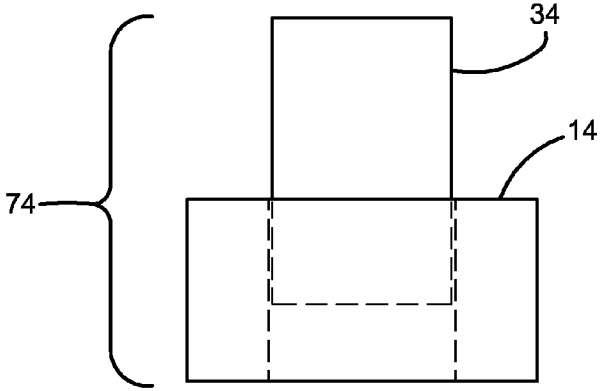
FIG. 7*a* shows an elongated shoe locator set.
Figure 7B:
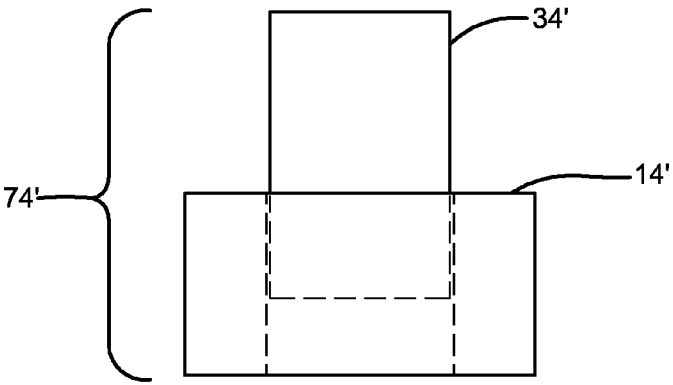
FIG. 7*b* shows an elongated shoe locator set.
Figure 7C:
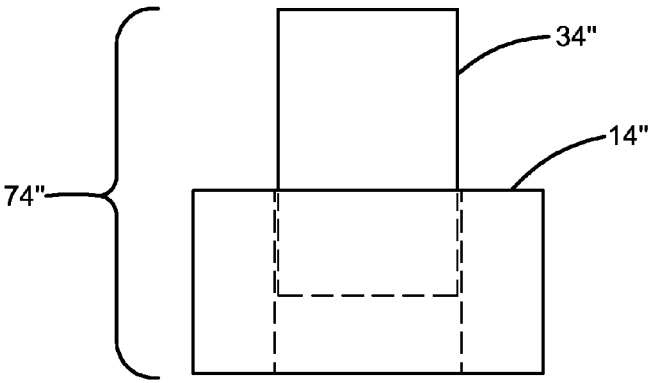
FIG. 7*c* shows an elongated shoe locator set
Figure 7D:
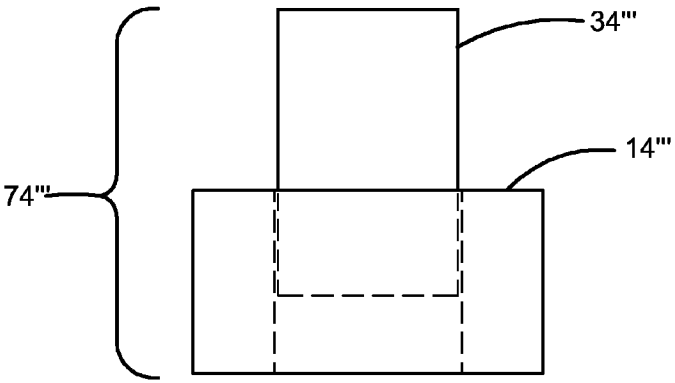
FIG. 7*d* shows an elongated shoe locator set.

As shown in FIGS. 4 and 5, the upper tool shoe 30 may optionally comprise features or components to facilitate installation or removal of the upper tool shoe 30 from the associated press 4. Features or components to facilitate installation or removal of the upper tool shoe 30 from the associated press 4 may comprise, but are not limited to, a bolting slot 31, through hole, or clamping point, or other feature adapted to be engaged or mated with a fastener engaged with the ram 7 of the associated press 4.

As shown in FIGS. 4 and 5, the upper tool shoe 30 may comprise the first upper tooling plate locator element 36, and the second upper tooling plate locator element 37. In some implementations, such as those shown in FIGS. 4 and 5, the first upper tooling plate locator element 36 may be fixed to the downwardly facing contact surface 32. In some implementations, such as those shown in FIGS. 4 and 5, the second upper tooling plate locator element 37 may be fixed to the downwardly facing contact surface 32. Each of the upper tooling plate locator elements 36, 37 is a component which is adapted to provide positive engagement in two dimensions to a counterpart element such as, without limitation, an upper tooling plate 60, 80, and thereby to be usable to define a location in two dimensions. The first upper tooling plate locator element 36 may define a first upper tooling plate locator element axis of elongation 38. The second upper tooling plate locator element 37 may define a second upper tooling plate locator element axis of elongation 39. In certain implementations, such as, and without limitation, that shown in FIGS. 4 and 5, the second upper tooling plate locator element 37 and the second upper tooling plate locator element axis of elongation 39 defined thereby, may be parallel with first upper tooling plate locator element axis of elongation 38. In certain implementations, such as, and without limitation, that shown in FIGS. 4 and 5, the second upper tooling plate locator element 37 and the second upper tooling plate locator element axis of elongation 39 defined thereby, may be parallel with and offset by some offset distance, $D_2$, from the first upper tooling plate locator element axis of elongation 38.

Each of the upper tooling plate locator elements 36, 37 may comprise a pin, a shaft, stud, a threaded projection, a cone locator, other male component, a blind hole, a through hole, a threaded hole, other female component, or other element chosen with sound engineering judgment. In some implementations, one or more of the upper tooling plate locator elements 36, 37 may have a substantially circular cross-section such that a counterpart element engaged therewith may be fixed in location in at least two dimensions, but is still free to rotate thereabout such that its orientation is not fixed. In some implementations, each of the upper tooling plate locator elements 36, 37 may have a substantially circular cross-section such that a counterpart element engaged with both an upper tooling plate locator elements 36, 37 may be fixed in location in at least two dimensions and is also fixed in orientation.

In the implementation shown in FIGS. 4 and 5, the upper tooling plate locator elements 36, 37 are fixed to the downwardly facing contact surface 32. The surface 32 defines a locator surface in a first dimension. Each of the upper tooling plate locator elements 36, 37 provides a location in two other dimensions, wherein each is other dimension is perpendicular to the first dimension, such that the upper tool locator elements 36, 37, in combination with the downwardly facing contact surface 32, provides a positive location in three dimensions. Engagement with the downwardly facing contact surface 32 and with the upper tool locator elements 36, 37 fixes the orientation and location of a counterpart element, such as, without limitation, either of the upper tooling plates 60, 80.

In certain implementations such as, without limitation, those shown in FIG. 4, the upper tool shoe 30 may comprise an upper tooling plate locator element array 49 comprising the plurality of upper tooling plate locator elements 36, 37. The upper tooling plate locator element array 49 may comprise ten upper tooling plate locator elements, one hundred upper tooling plate locator elements, or more upper tooling plate locator elements. The upper tooling plate locator element array 49 may be a rectangular array, a hexagon array, or another sort of array chosen with sound engineering judgment.

Referring now to FIGS. 4-5, shown are the first upper tooling plate 60, and the second upper tooling plate 80. The first upper tooling plate 60 may be a component of the first tooling plate set 50, 60 and may be the counterpart to the first lower tooling plate 50. The second upper tooling plate 80 may be a component of a second set of tooling plates 70, 80 and may be the counterpart to the second lower tooling plate 70.

In FIG. 4, the first upper tooling plate 60 may be adapted to be positively located on the downwardly facing contact surface 32 of the upper tool shoe 30. Engagement of the first upper tooling plate 60 with the downwardly facing contact surface 32 may be by simultaneous engagement with the downwardly facing contact surface 32, engagement with the first upper tooling plate locator element 36, and engagement with the second upper tooling plate locator element 37. Engagement of the first upper tooling plate 60 with the downwardly facing contact surface 32 may be affected by securing the first upper tooling plate 60 onto the downwardly facing contact surface 32 by means including, but not limited to mechanical fasteners. Engagement of the first upper tooling plate 60 with the first upper tooling plate locator element 36 may be affected by engaging the mechanical locator 52 with the first upper tooling plate locator element 36 and with the first upper tooling plate 60. Engagement of the first upper tooling plate 60 with the second upper tooling plate locator element 37 may be affected by engaging a mechanical locator 52 with the first upper tooling plate locator element 36 and with the first upper tooling plate 60. The first upper tooling plate 60 may be further engaged with the upper tool shoe 30 by mechanical fasteners such as bolts or nuts.

In FIG. 5, the second upper tooling plate 80 is adapted to be positively located on the downwardly facing contact surface 32 of upper tool shoe 30. Engagement of the second upper tooling plate 80 with downwardly facing contact surface 32 may be by simultaneous engagement with the downwardly facing contact surface 32, engagement with the first upper tooling plate locator element 36, and engagement with the second upper tooling plate locator element 37. Engagement of the second upper tooling plate 80 with the downwardly facing contact surface 32 may be affected by placing the second upper tooling plate 80 on the downwardly facing contact surface 32. Engagement of the second upper tooling plate 80 with the first upper tooling plate locator element 36 may be affected by engaging a mechanical locator 52 with the first upper tooling plate locator element 36 and with second upper tooling plate 80. Engagement of second upper tooling plate 80 with the second upper tooling plate locator element 37 may be affected by engaging a mechanical locator 52 with the first upper tooling plate locator element 36 and with second upper tooling plate 80. The second upper tooling plate 80 may be further engaged with the upper tool shoe 30 by mechanical fasteners such as bolts or nuts.

Referring now to FIGS. 1-7*d*, the lower tool shoe 10 may comprise the first part 14 of the first elongated shoe locator set 74. The first part 14 of the first elongated shoe locator set 74 may be adapted for engagement with the second part 34 of the first elongated shoe locator set 74. Accordingly, the first elongated shoe locator set 74 may comprise the first part 14 of the first elongated shoe locator set 74 and the second part 34 of the first elongated shoe locator set 74. The first elongated shoe locator set 74 may define a shoe locator set axis of elongation 15. In certain implementations, such as that shown in FIG. 1, the shoe locator set axis of elongation 15 may be parallel to the first lower tooling plate locator element axis of elongation 18. The first part 14 of the first elongated shoe locator set 74 may be adapted to provide fixed engagement in two dimensions perpendicular to the axis of elongation 15 to a second part 34 of the first elongated shoe locator set, and slidable engagement in a third dimension parallel to the axis of elongation 15, and thereby to be usable to locate the first part 14 and the second part 34 relative to one another in the two dimensions perpendicular to axis of elongation 15. As shown in FIGS. 1-5, the lower tool shoe 10 may be fixedly engaged with the first part 14 of the first elongated shoe locator set 74 and the upper tool shoe 30 may be fixedly engaged with second part 34 of the first elongated shoe locator set 74 so that locating the first part 14 and the second part 34 relative to one another in the two dimensions perpendicular to axis of elongation 15, also locates the lower tool shoe 10 and the upper tool shoe 30 relative to one another in the two dimensions perpendicular to axis of elongation 15.

In the implementation shown in FIGS. 1-7*d*, the lower tool shoe 10 and the upper die shoe 30 comprise a plurality of elongated shoe locator sets 74, 74', 74", 74'". The lower tool shoe 10 may comprise a first part 14 of a first elongated shoe locator set 74, a first part 14' of a second elongated shoe locator set 74', a first part 14" of a third elongated shoe locator set 74", and a first part 14'" of a fourth elongated shoe locator set 74'". The upper die shoe 30 may comprise a second part 34 of the first elongated shoe locator set 74, a second part 34' of the second elongated shoe locator set 74', a second part 34" of the third elongated shoe locator set 74", and a second part 34'" of the fourth elongated shoe locator set 74'". The second elongated shoe locator set 74' may be comprised of the first part 14' and the second part 34' and may define the shoe locator set axis of elongation 15'. Shoe locator set axis of elongation 15' may be parallel to shoe locator set axis of elongation 15. The third elongated shoe locator set 74" may be comprised of the first part 14" and the second part 34" and may define the shoe locator set axis of elongation 15". Shoe locator set axis of elongation 15" may be parallel to shoe locator set axis of elongation 15. The fourth elongated shoe locator set may be comprised of the first part 14'" and the second part 34'" and may define a shoe locator set axis of elongation 15'". Shoe locator set axis of elongation 15'" may be parallel to shoe locator set axis of elongation 15. In the implementation shown in FIGS. 1-7*d*, the lower tool shoe 10 may be fixedly engaged with the first part 14 of the first elongated shoe locator set 74, the first part 14' of a second elongated shoe locator set 74', the first part 14" of a third elongated shoe locator set 74", and the first part 14'" of a fourth elongated shoe locator set 74'". In the implementation shown in FIGS. 1-5, the upper tool shoe 30 may be fixedly engaged with the second part 34 of the first elongated shoe locator set 74, the second part 34' of the second elongated shoe locator set 74', the second part 34" of the third elongated shoe locator set 74", and the second part 34'" of the fourth elongated shoe locator set 74'". In the implementation shown in FIGS. 1-7*d*, locating the first part 14 and the second part 34 relative to one another in the two dimensions perpendicular to axis of elongation 15, locating the first part 14' and the second part 34' relative to one another in the two dimensions perpendicular to axis of elongation 15, locating the first part 14" and the second part 34" relative to one another in the two dimensions perpendicular to axis of elongation 15, and locating the first part 14'" and the second part 34'" relative to one another in the two dimensions perpendicular to axis of elongation 15, also locates the lower tool shoe 10 and the upper tool shoe 30 relative to one another in the two dimensions perpendicular to axis of elongation 15 and fixed the orientation of the lower tool shoe 10 and the upper tool shoe 30 relative to one another. In certain implementations, the tool shoes 10, 30 may comprise one, two, three, four, or more elongated shoe locator sets 74, 74', 74", 74'".

One implementation of the lower die shoe 10 and the upper die shoe 30 is shown in FIGS. 2 and 4 comprising the first tooling plate set 50, 60 which may comprise first lower tooling plate 50 and first upper tooling plate 60. In the non-limiting implementation shown in FIG. 2, the first lower tooling plate 50 comprises a tooling or forming component 56. In the non-limiting implementation shown in FIG. 4, the first upper tooling plate 60, shown in phantom form, may be the counterpart to first lower tooling plate 50 and may comprise a tooling or forming component 66, also shown in phantom form, that is a counterpart to the tooling or forming component 56.

One implementation of the lower die shoe 10 and the upper die shoe 30 is shown in FIGS. 3 and 5 comprising the second tooling plate set which may comprise second lower tooling plate 70 and second upper tooling plate 80. In the non-limiting implementation shown in FIG. 3, the second lower tooling plate 70 comprises a tooling or forming component 76. In the non-limiting implementation shown in FIG. 5, the second upper tooling plate 80, shown in phantom form, may be the counterpart to second lower tooling plate 70 and may comprise a tooling or forming component 86, also shown in phantom form, that is a counterpart to the tooling or forming component 76.

In certain implementations, there may be other tooling plate sets (not shown) that may be engaged with the lower die shoe 10 and the upper die shoe 30.

The lower die shoe 10 may be adapted to operationally engage either the first lower tooling plate 50 or the second lower tooling plate 70 in the alternative to one another. That is, in certain implementations, the lower die shoe 10 may be adapted to operationally engage first lower tooling plate 50, and may be adapted to operationally engage second lower tooling plate 70, but not both simultaneously. The first lower tooling plate 50 and the second lower tooling plate 70 may be exchanged, that is, swapped out, for one another.

The upper die shoe 30 may be adapted to operationally engage either the first upper tooling plate 60 or the second upper tooling plate 80 in the alternative to one another. That is, in certain implementations, the upper die shoe 30 may be adapted to operationally engage first upper tooling plate 60, and may be adapted to operationally engage second upper tooling plate 80, but not both simultaneously. The first upper tooling plate 60 and the second upper tooling plate 80 may be exchanged, that is, swapped out, for one another.

In implementations in which the first lower tooling plate 50 and the second lower tooling plate 70 may be exchanged for one another and in which the first upper tooling plate 60 and the second upper tooling plate 80 may be exchanged for one another, it is a simple matter to change out the first tooling plate set 50, 60 for the second tooling plate set 70, 80 or vice versa. This exchangeability of the tooling plate sets 50, 60, 70, 80 allows the associated press 4 to be changed between an operational configuration using the first tooling plate set 50, 60 to an to operational configuration using the second tooling plate set 70, 80 (or vice versa) without necessitating the removal of the lower die shoe 10 or the upper die shoe 30 from the associated press 4.

In certain methods of use, the interchangeable tooling system may be installed in an associated press 4 by a number of steps. One of the number of steps may be engaging the lower tool shoe 10 with the bed 5 of the associated press 4 such that the upwardly facing contact surface 12 faces in opposition to the ram 7, and by engaging the upper tool shoe 30 with the ram 7 of the associated press 4 such that the downwardly facing contact surface 32 faces in opposition to the bed 5. The lower tool shoe 10 may further comprise lower tooling plate locator elements 16, 17. The upper tool shoe 30 may further comprise upper tooling plate locator elements 36, 37. Another of the number of steps may be engaging the first tooling plate set 50, 60 with the associated press 4 by engaging the first lower tooling plate 50 with the lower tool shoe 10 by engaging the first lower tooling plate 50 with each of the upwardly facing contact surface 12, the lower tooling plate locator element 16, and the lower tooling plate locator element 17, and by engaging the first upper tooling plate 60 with the upper tool shoe 30 by engaging the first upper tooling plate 60 with each of the downwardly facing contact surface 32, the upper tooling plate locator element 36, and the upper tooling plate locator element 37. Another of the number of steps may be engaging the second tooling plate set 70, 80 with the associated press 4 by engaging the second lower tooling plate 70 with the lower tool shoe 10 by engaging the second lower tooling plate 70 with each of the upwardly facing contact surface 12, the lower tooling plate locator element 16, and the lower tooling plate locator element 17, and by engaging the second upper tooling plate 80 with the upper tool shoe 30 by engaging the second upper tooling plate 80 with each of the downwardly facing contact surface 32, the upper tooling plate locator element 36, and the upper tooling plate locator element 37.

In certain methods of use, the first tooling plate set 50, 60 and the second tooling plate set may be interchanged without necessitating the removal of the lower die shoe 10 or the upper die shoe 30 from the associated press 4. In some such methods, one of the number of steps may comprise a) disengaging the first tooling plate set 50, 60 from the associated press 4 by disengaging the first lower tooling plate 50 from the lower tool shoe 10 by disengaging the first lower tooling plate 50 from each of the upwardly facing contact surface 12, the lower tooling plate locator element 16, and the lower tooling plate locator element 17, and by disengaging the first upper tooling plate 60 from the upper tool shoe 30 by disengaging the first upper tooling plate 60 from each of the downwardly facing contact surface 32, the upper tooling plate locator element 36, and the upper tooling plate locator element 37; and b) engaging the second tooling plate set 70, 80 with the associated press 4 by engaging the second lower tooling plate 70 with the lower tool shoe 10 by engaging the second lower tooling plate 70 with each of the upwardly facing contact surface 12, the lower tooling plate locator element 16, and the lower tooling plate locator element 17, and by engaging the second upper tooling plate 80 with the upper tool shoe 30 by engaging the second upper tooling plate 80 with each of the downwardly facing contact surface 32, the upper tooling plate locator element 36, and the upper tooling plate locator element 37. In some such methods, one of the number of steps may comprise a) disengaging the second tooling plate set 70, 80 from the associated press 4 by disengaging the second lower tooling plate 70 from the lower tool shoe 10 by disengaging the second lower tooling plate 70 from each of the upwardly facing contact surface 12, the lower tooling plate locator element 16, and the lower tooling plate locator element 17, and by disengaging the second upper tooling plate 80 from the upper tool shoe 30 by disengaging the second upper tooling plate 80 from each of the downwardly facing contact surface 32, the upper tooling plate locator element 36, and the upper tooling plate locator element 37; and b) engaging the first tooling plate set 50, 60 with the associated press 4 by engaging the first lower tooling plate 50 with the lower tool shoe 10 by engaging the first lower tooling plate 50 with each of the upwardly facing contact surface 12, the lower tooling plate locator element 16, and the lower tooling plate locator element 17, and by engaging the first upper tooling plate 60 with the upper tool shoe 30 by engaging the first upper tooling plate 60 with each of the downwardly facing contact surface 32, the upper tooling plate locator element 36, and the upper tooling plate locator element 37.

In certain methods of the lower tool shoe 10 may further comprise and be fixedly engaged with a first part 14 of a first elongated shoe locator set 74 which defines a shoe locator set axis of elongation 15 and, optionally, a first part 14' of a second elongated shoe locator set 74'; and the upper tool shoe 30 may further comprise and be fixedly engaged with a second part 34 of the first elongated shoe locator set 74 and, optionally, a second part 34' of the second elongated shoe locator set 74'. In such methods, one of the number of steps may comprise locating the lower tool shoe 10 and the upper tool shoe 30 relative to one another in the two dimensions perpendicular to axis of elongation 15 by engaging the first part 14 of the first elongated shoe locator set 74 with the second part 34 of the first elongated shoe locator set 74, and, optionally, by engaging the first part 14' of a second elongated shoe locator set 74' with the second part 34' of the second elongated shoe locator set 74'.

While the interchangeable tooling system has been described above in connection with certain implementations, it is to be understood that other implementations may be used or modifications and additions may be made to the described implementations for performing the same function of the interchangeable tooling system without deviating therefrom. Further, the interchangeable tooling system may include implementations disclosed but not described in exacting detail. Further, all implementations disclosed are not necessarily in the alternative, as various implementations may be combined to provide the desired characteristics. Variations can be made by one having ordinary skill in the art without departing from the spirit and scope of the interchangeable tooling system. Therefore, the interchangeable tooling system should not be limited to any single implementation, but rather construed in breadth and scope in accordance with the recitation of the attached claims.

What is claimed is:

1. A tooling system for use in an associated press, said tooling system comprising:

a lower tool shoe comprising, an upwardly facing contact surface, a first part of a first elongated shoe locator set, said shoe locator set defining a shoe locator set axis of elongation, a first lower tooling plate locator element, said first lower tooling plate locator element, defines a first lower tooling plate locator element axis of elongation, where said first lower tooling plate locator element axis of elongation is parallel to said shoe locator set axis of elongation, and is fixed to said upwardly facing contact surface, a second lower tooling plate locator element, said second lower tooling plate locator element, defines a second lower tooling plate locator element axis of elongation, where said second lower tooling plate locator element axis of elongation, is parallel to said first lower tooling plate locator element axis of elongation, and is offset from said first lower tooling plate locator element axis of elongation, and is fixed to said upwardly facing contact surface;

an upper tool shoe comprising, a downwardly facing contact surface, a second part of said first elongated shoe locator set, a first upper tooling plate locator element, said first upper tooling plate locator element defines a first upper tooling plate locator element axis of elongation, where said first upper tooling plate locator element axis of elongation is parallel to said shoe locator set axis of elongation, and is fixed to said downwardly facing contact surface, a second upper tooling plate locator element, said second upper tooling plate locator element, defines a second upper tooling plate locator element axis of elongation, where said second upper tooling plate locator element axis of elongation, is parallel to said first upper tooling plate locator element axis of elongation, and is offset from said first upper tooling plate locator element axis of elongation, and is fixed to said upwardly facing contact surface;

a first set of tooling plates comprising, a first lower tooling plate adapted to be positively located on said upwardly facing contact surface by simultaneous engagement with said upwardly facing contact surface, said first lower tooling plate locator element, and said second lower tooling plate locator element, a first upper tooling plate adapted to be positively located on said downwardly facing contact surface by simultaneous engagement with said downwardly facing contact surface, said first upper tooling plate locator element, and said second upper tooling plate locator element; and a second set of tooling plates comprising, a second lower tooling plate adapted to be positively located on said upwardly facing contact surface by simultaneous engagement with said upwardly facing contact surface, said first lower tooling plate locator element, and said second lower tooling plate locator element, a second upper tooling plate adapted to be positively located on said downwardly facing contact surface by simultaneous engagement with said downwardly facing contact surface, said first upper tooling plate locator element, and said second upper tooling plate locator element.

2. The tooling system of claim 1, wherein at least one tooling plate locator element is a stud.

3. The tooling system of claim 2, wherein said upwardly facing contact surface comprises at least one removably fixed component.

4. The tooling system of claim 3, wherein said shoe locator set comprises a female component and a male component.

5. A method of interchanging a set of tooling plates, comprising:

providing a tooling system for use in an associated press, said tooling system comprising:

a lower tool shoe comprising, an upwardly facing contact surface, a first part of a first elongated shoe locator set, said shoe locator set defining a shoe locator set axis of elongation, a first lower tooling plate locator element, said first lower tooling plate locator element, defines a first lower tooling plate locator element axis of elongation, where said first lower tooling plate locator element axis of elongation is parallel to said shoe locator set axis of elongation, and is fixed to said upwardly facing contact surface, a second lower tooling plate locator element, said second lower tooling plate locator element, defines a second lower tooling plate locator element axis of elongation, where said second lower tooling plate locator element axis of elongation, is parallel to said first lower tooling plate locator element axis of elongation, and is offset from said first lower tooling plate locator element axis of elongation, and is fixed to said upwardly facing contact surface;

an upper tool shoe comprising, a downwardly facing contact surface, a second part of said first elongated shoe locator set, a first upper tooling plate locator element, said first upper tooling plate locator element defines a first upper tooling plate locator element axis of elongation, where said first upper tooling plate locator element axis of elongation is parallel to said shoe locator set axis of elongation, and is fixed to said downwardly facing contact surface, a second upper tooling plate locator element, said second upper tooling plate locator element, defines a second upper tooling plate locator element axis of elongation, where said second upper tooling plate locator element axis of elongation, is parallel to said first upper tooling plate locator element axis of elongation, and is offset from said first upper tooling plate locator element axis of elongation, and is fixed to said upwardly facing contact surface;

a first set of tooling plates comprising, a first lower tooling plate adapted to be positively located on said upwardly facing contact surface by simultaneous engagement with said upwardly facing contact surface, said first lower tooling plate locator element, and said second lower tooling plate locator element, a first upper tooling plate adapted to be positively located on said downwardly facing contact surface by simultaneous engagement with said downwardly facing contact surface, said first upper tooling plate locator element, and said second upper tooling plate locator element; and a second set of tooling plates comprising, a second lower tooling plate adapted to be positively located on said upwardly facing contact surface by simultaneous engagement with said upwardly facing contact surface, said first lower tooling plate locator element, and said second lower tooling plate locator element, a second upper tooling plate adapted to be positively located on said downwardly facing contact surface by simultaneous engagement with said downwardly facing contact surface, said first upper tooling plate locator element, and said second upper tooling plate locator element;

engaging said first lower tooling plate with each of said upwardly facing contact surface, said first lower tooling plate locator element, and said second lower tooling plate locator element;

engaging said first upper tooling plate with each of said downwardly facing contact surface, said first lower tooling plate locator element, and said second lower tooling plate locator element;

disengaging said first lower tooling plate from each of said upwardly facing contact surface, said first lower tooling plate locator element, and said second lower tooling plate locator element;

disengaging said first upper tooling plate from each of said downwardly facing contact surface, said first lower tooling plate locator element, and said second lower tooling plate locator element;

engaging said second lower tooling plate with each of said upwardly facing contact surface, said first lower tooling plate locator element, and said second lower tooling plate locator element; and engaging said second upper tooling plate with each of said downwardly facing contact surface, said first lower tooling plate locator element, and said second lower tooling plate locator element.

* * * * *